US009084059B2

(12) United States Patent
Breece, III et al.

(10) Patent No.: US 9,084,059 B2
(45) Date of Patent: Jul. 14, 2015

(54) ELECTRONIC AUDIO DEVICE TO DETERMINE MATCHING AND NON-MATCHING SPEAKERS

(75) Inventors: David C. Breece, III, Sunnyvale, CA (US); Nathan A. Johanningsmeir, San Jose, CA (US); Cara S. Yang, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 254 days.

(21) Appl. No.: 13/592,164

(22) Filed: Aug. 22, 2012

(65) Prior Publication Data

US 2013/0329897 A1 Dec. 12, 2013

Related U.S. Application Data

(60) Provisional application No. 61/657,533, filed on Jun. 8, 2012.

(51) Int. Cl.
*H04R 29/00* (2006.01)

(52) U.S. Cl.
CPC ..... *H04R 29/00* (2013.01)

(58) Field of Classification Search
CPC .... H04R 29/001; H04R 5/04; H04R 2420/05; H04R 29/00; H04S 7/308
USPC ..... 381/55, 58, 59, 96, 98, 103, 120, 123, 381/107, 108, 74, 119
See application file for complete search history.

(56) References Cited

U.S. PATENT DOCUMENTS

| | | | | |
|---|---|---|---|---|
| 4,124,786 | A | 11/1978 | Kircher | |
| 5,815,584 | A * | 9/1998 | Whitecar et al. | 381/86 |
| 6,359,987 | B1 * | 3/2002 | Tran et al. | 381/58 |
| 7,099,481 | B2 * | 8/2006 | Baker et al. | 381/58 |
| 7,764,797 | B2 | 7/2010 | Yamamoto et al. | |
| 8,063,698 | B2 * | 11/2011 | Howard | 330/51 |
| 2004/0081099 | A1 * | 4/2004 | Patterson et al. | 370/241 |
| 2005/0175195 | A1 * | 8/2005 | Cheney et al. | 381/120 |
| 2013/0251165 | A1 * | 9/2013 | Jorgensen et al. | 381/59 |

FOREIGN PATENT DOCUMENTS

| | | |
|---|---|---|
| CN | 102348148 | 2/2012 |
| JP | 2003-018700 | 1/2003 |

* cited by examiner

*Primary Examiner* — Vivian Chin
*Assistant Examiner* — Jason R Kurr
(74) *Attorney, Agent, or Firm* — Blakely, Sokoloff, Taylor & Zafman LLP

(57) ABSTRACT

An electronic audio system that determines matching and non-matching speakers is disclosed. The electronic audio system includes a first speaker; a second speaker; and a comparator circuit. The comparator circuit is coupled to the first speaker and the second speaker to receive an input signal from both the first and second speaker. The comparator circuit is configured to determine if the first speaker and the second speaker are matching speakers or non-matching speakers, in which, the first and second speakers are matching speakers if they are common vendor speakers. Other embodiments are also described and claimed.

22 Claims, 9 Drawing Sheets

ELECTRONIC AUDIO DEVICE TO DETERMINE MATCHING AND NON-MATCHING SPEAKERS

CROSS-REFERENCE TO RELATED APPLICATION

This application is based upon and claims the benefit of priority from U.S. Provisional Patent Application No. 61/657,533, filed on Jun. 8, 2012; the entire contents of which are incorporated herein by reference.

FIELD

An embodiment of the invention relates to an electronic audio device that determines whether speakers are matching or non-matching. Other embodiments are also described.

BACKGROUND

Relying upon multiple speaker vendors for the purchase of speaker components in the manufacturing of electronic audio devices would be helpful in that it would improve supply chain reliability and would drive down costs. However, one issue with relying upon multiple speaker vendors is that the response from each type of vendor speaker needs to be equalized by a software program of the electronic audio device. Each equalizer 'EQ' software program is typically designed for speakers from a particular vendor, so in order to maintain the best level of audio performance, a different EQ software program needs to be implemented by the electronic audio device, based upon the vendor speaker installed in the electronic audio device.

Another issue that may occur is that one speaker from one vendor may be installed on the electronic audio device as well as another speaker from another vendor, which results in a faulty speaker system. This may occur either by accident during manufacturing or during a re-work of the electronic audio device.

SUMMARY

An embodiment of the invention is an electronic audio system that determines whether speakers are matching or non-matching speakers (i.e., whether the speakers are from a common speaker vendor or from different speaker vendors). For example, the electronic audio system may include: a first speaker; a second speaker; and a comparator circuit. The comparator circuit may be coupled to the first speaker and the second speaker and may receive an input signal from both the first and second speaker. The comparator circuit may be configured to determine if the first speaker and the second speaker are matching speakers or non-matching speakers based upon the received input signals. If the first and second speakers are matching speakers then they are from a common vendor. If the first and second speakers are not matching speakers, then they are from different vendors.

In one embodiment, if matching speakers from a common vendor are determined by the comparator circuit, an appropriate state signal is transmitted to and received by a processor such that the processor executes appropriate equalizing ('EQ') software for the particular vendor speaker. On the other hand, if the comparator circuit determines that the first and second speakers are non-matching speakers (i.e., they are different vendor speakers), then a particular state signal is transmitted to and received by the processor such that processor executes software to display that the speakers are from different vendors. In this way, a manufacturer or technician can be alerted that different vendor speakers have been installed and this error can be resolved.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
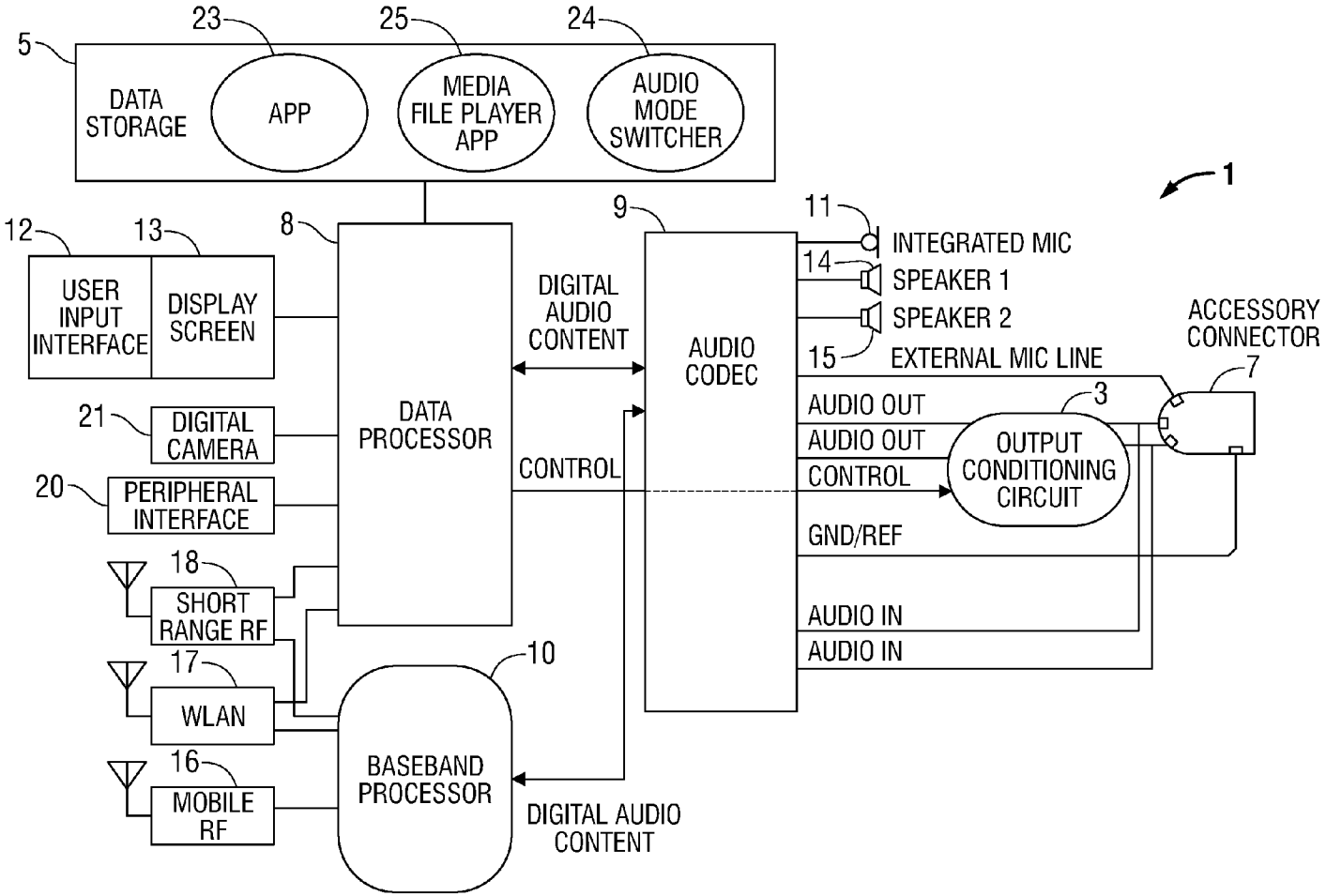
FIG. 1 is a combined block diagram and circuit schematic of relevant portions of a portable computing device, as an example of an audio system.

Before addressing the aspects of how to determine whether speakers are matching or non-matching speakers (i.e., whether the speakers are from a common speaker vendor or from different speaker vendors), a combined block diagram and circuit schematic of relevant portions of a portable communications device as an example of the audio system 1 is presented in FIG. 1. However, as will be described, the audio system may likewise be implemented in a non-portable device.

Being a portable device, the audio system 1 depicted in FIG. 1 is not only battery powered but also has several wireless communications interfaces, including a short range RF interface 18 (e.g., Bluetooth compatible), a wireless local area network interface 17 (also referred to as WiFi), and a mobile RF interface 16 (also referred to as a cellular terrestrial radio access network transceiver). A baseband processor 10 is responsible for digital encoding and decoding of communication content in the baseband or intermediate frequency band; such content may include audio content in the form of a downlink audio signal from a remote device (not shown) that may contain, for instance, the speech of a far-end user, and an uplink signal that may contain speech of a near-end user of the audio system 1.

It should appreciated that the embodiments of the invention related to a comparator circuit in an electronic audio system to determine whether speakers are matching or non-matching speakers, as will be described, may be part of any portable or non-portable computing device. It should be appreciated that an audio system may be employed with any type of computing device: personal desktop computer, laptop computer, mobile computer, mobile device, etc.

The audio system 1 depicted in FIG. 1 may also include other hardware such as a digital camera 21, and a local or peripheral interface 20 (e.g., a docking connector and associated circuitry, a universal serial bus interface). A display screen 13 is also provided, together with a user input interface 12. The latter may be in the form of a physical keyboard, keypad, or touch panel with the display screen 13 forming a touch screen.

The various functions of the audio system 1 may be managed by a data processor 8, which may be an applications processor, a central processing unit, or a system on a chip (SoC). The term "data processor" is used generically here to refer to any suitable combination of data processing circuitry. The data processor 8 is programmed by instructions stored in data storage 5, depicted here as applications or modules including an application 23 (e.g., a word processing application or an Internet browser application), and a media file player application 25 (to enable playback or streaming of digital audio and video files). The data storage 5 may be composed of non-volatile memory such as flash memory or a hard disk drive, in addition to random access memory. The data storage 5 may also have stored therein an audio mode switcher 24 which programs the processor 8 to select an audio output mode of operation, being one of line out mode and headphone mode. In so doing, the audio mode switcher 24 controls or configures an output conditioning circuit 3 in order to change output impedance that is presented at one or more signal pins of the accessory connector 7.

Audio output may be achieved through the accessory connector 7, which may be integrated within the housing (not shown) of the audio system 1 together with the hardware components depicted in FIG. 1. The accessory connector 7 may be a headphone or earphone jack, such as a 4-pin TRRS connector. The four pins include an external microphone line pin, left and right speaker pins, and a ground or reference pin. Other pin assignments and jack styles are possible. In general, the connector 7 is designed to interface the audio system 1 with an external device, namely an accessory device such as a directly powered headset, or a standalone device such as a speaker or an audio receiver (amplifier). Examples include integrated (e.g., hardwired and soldered) left and right speakers 14, 15 or attachable left and right speakers 14, 15.

The pins of the accessory connector 7 are coupled to an audio codec 9. The codec 9 is an integrated circuit having a digital to analog converter (DAC), an analog to digital converter (ADC), and an audio power amplifier. The audio codec 9 may be a single integrated circuit die that is separately packaged by itself or in combination with other circuitry, as an audio IC package. It has, in this case, at least two analog audio output pins labeled "audio out" that are driven by their respective power amplifiers, through an output conditioning circuit 3, before passing through the corresponding signal pins of the accessory connector 7. The audio content is driven by the audio codec 9 relative to the ground/reference pin of the connector 7. The audio content that is output by the codec 9 may be produced or routed by the data processor 8 (e.g., while playing a digital audio file under control of the media file player app 25), or the baseband processor 10 which may be decoding and delivering a downlink speech signal during a call. Codec 9 also has several input pins, including an external mic line input and, in this case, at least two separate audio input pins. The external microphone line allows the audio codec 9 to receive input audio content from an external device, e.g., speech of a near-end user, through the mic pin of the accessory connector 7.

Figure 2:
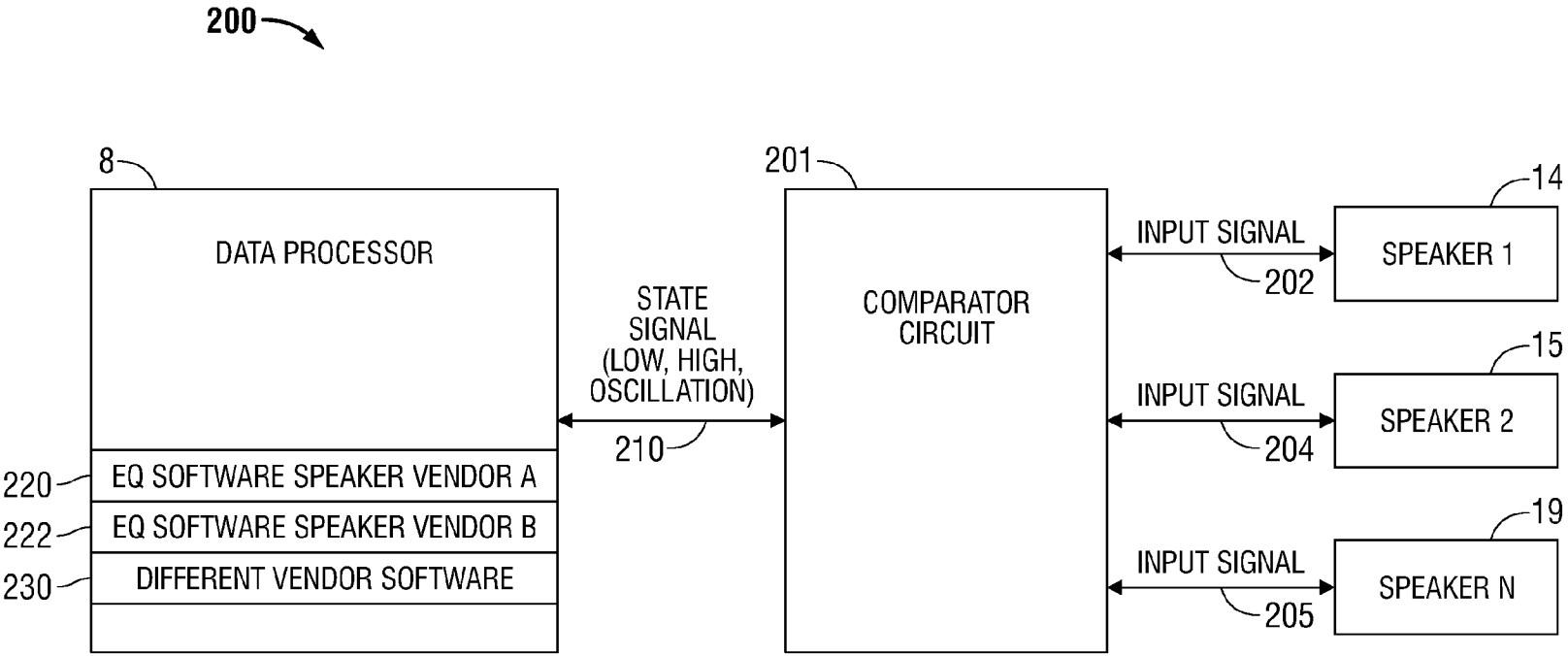
FIG. 2 is a block diagram of an audio system including a comparator circuit that is used to determine whether speakers are matching or non-matching speakers.

FIG. 2 shows an embodiment of an electronic audio system 200 that determines whether speakers are matching or non-matching speakers. In particular, whether the speakers are from a common speaker vendor (matching) or from different speaker vendors (non-matching). For example, the electronic audio system 200 may include: a first speaker 14; a second speaker 15; and a comparator circuit 201. Comparator circuit 201 may be coupled to the first speaker 14 and the second speaker 15 and may receive an input signal 202 from the first speaker 14 and an input signal 204 from the second speaker 15.

Comparator circuit 201 may be configured to determine if the first speaker 14 and the second speaker 15 are matching speakers (e.g., from common speaker vendors) or non-matching speakers (e.g., from different speaker vendors) based upon the received input signals 202 and 204. In particular, if the first and second speakers 14 and 15 are matching speakers then they are most probably from a common vendor. On the other hand, if the first and second speakers 14 and 15 are non-matching speakers, then they are most probably from different vendors.

It should be appreciated that the use of a first speaker 14 and second speaker 15 are merely examples of a pre-determined number of speakers (e.g., two speakers) and that any number of speakers up through speaker N 19 having corresponding input signals 205 may also be coupled to comparator circuit 201, in which, the comparator circuit 201 may determine whether the speakers 1-N are matching or non-matching speakers.

Further, comparator circuit 201 may be coupled to data processor 8 to provide a state signal 210 to data processor 8. Therefore, data processor 8 receives a state signal 210 from comparator circuit 201. The state signal 210 may indicate to data processor 8 whether the attached first and second speakers 14 and 15 are matching speakers or non-matching speakers.

As an example, in one embodiment, a first set of common vendor speakers 14 and 15 provide input signals 202 and 204 to comparator circuit 201 that causes comparator circuit 201 to output a low state signal 210 to data processor 8. The low state signal 210 is received by data processor 8 and data processor 8 executes equalizing software associated with the first set of common vendor speakers 14 and 15. Thus, if matching speakers 14 and 15 are from a common vendor, as determined by compactor circuit 201, an appropriate state signal 210 is transmitted to and received by data processor 8, and based upon the received state signal 210, data processor 8 executes appropriate equalizing (EQ) software for the particular vendor speaker.

In this particular example, the first and second speakers 14 and 15 are from a vendor A, and each speaker provides an input signal 202 and 204 to comparator circuit 201, that outputs a low state signal 210 to data processor 8. Data processor 8 based upon the low state signal 210 implements EQ software 220 that is particular for speaker vendor A. In this way, a proper level of audio performance is implemented for the first and second speakers 14 and 15 that are from vendor A.

Similarly, the first and second speakers 14 and 15 may be a second set of common vendor speakers associated with another vendor, such as, vendor B. In this example, the first and second speakers 14 and 15 provide an input signal 202 and 204 to comparator circuit 201 that causes comparator circuit 201 to output a state signal 210 to data processor 8. In this example, if matching first and second speakers 14 and 15 are from another common vendor (e.g., vendor B), as determined by compactor circuit 201, an appropriate high state signal 210 is transmitted to and received by data processor 8.

Based upon the received high state signal 210, data processor 8 executes appropriate EQ software for the particular vendor speaker (vendor B). In this example, data processor 8 executes equalizing software 222 for vendor B that is associated with the second set of common vendor speakers 14 and 15 from vendor B to provide optimal audio preference.

On the other hand, if the first and second speakers 14 and 15 provide input signals 202 and 204 to comparator circuit 201, such that, comparator circuit 201 determines that the first and second speakers 14 and 15 are non-matching speakers (e.g., they are different vendor speakers), then a state signal 210 indicating non-matching speakers is transmitted to and received by data processor 8. In this example, the state signal indicating non-matching speakers is an oscillation state signal 210. Based upon the receipt of the oscillation state signal 210, data processor 8 executes different vendor software 230 that displays (e.g., via display screen 13 or a sound device) that the first and second speakers 14 or 15 are from different vendors and that an error has occurred. Also, instead of display software and/or a display, a diagnostic tool may be used to determine if the first and second speakers 14 or 15 are from different vendors and that an error has occurred. In these ways, manufacturing personnel or a technician can be alerted that different vendor speakers have been incorrectly installed such that they can resolve this error. For example, they can remove and replaces the speakers to make sure that common vendor speakers are installed. As an example, speaker(s) 14 and/or 15 may be de-soldered and detached and new vendor replacement speakers may be hardwired and soldered and attached.

Figure 3:
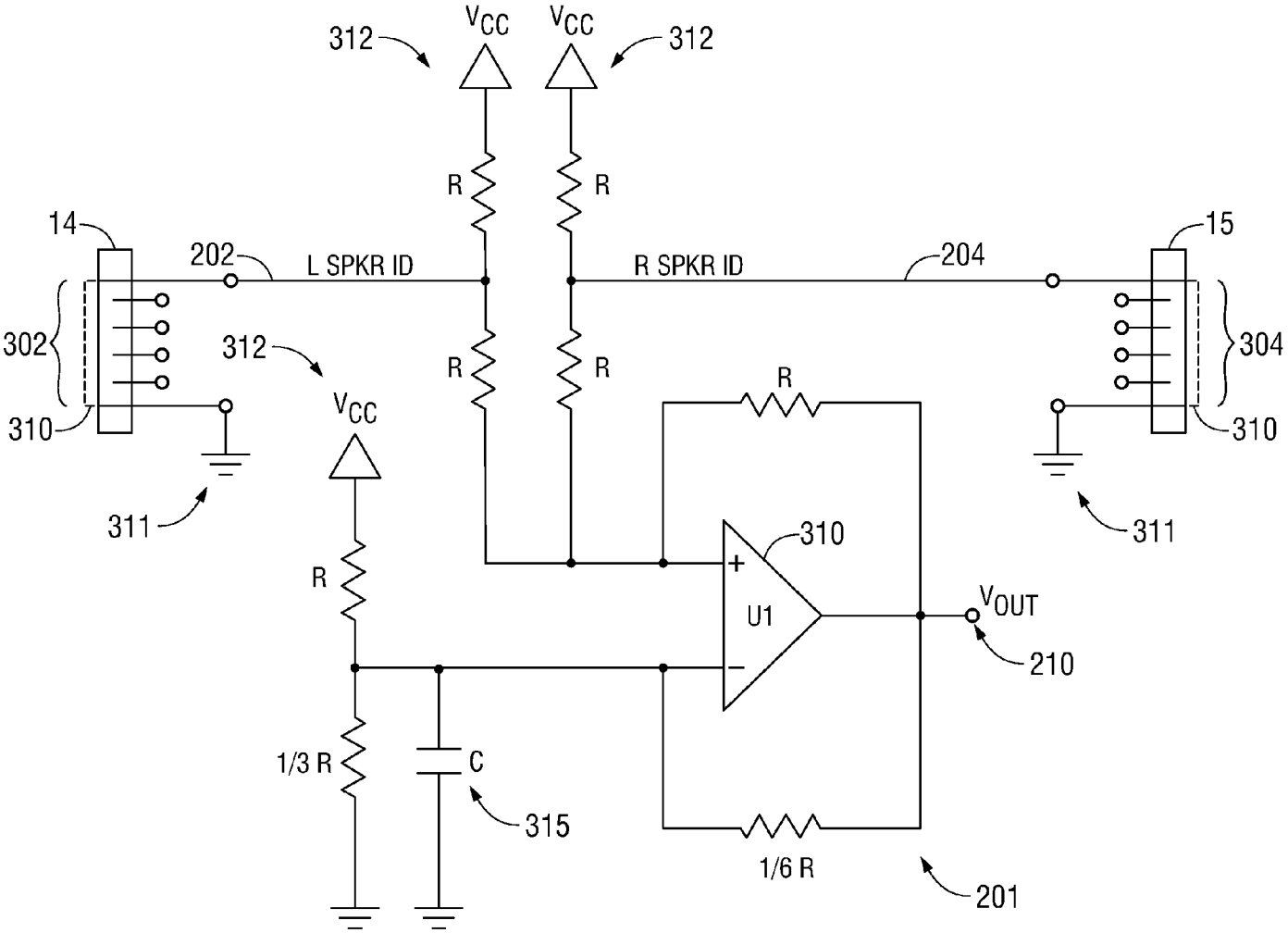
FIG. 3 is a circuit diagram of a comparator circuit that is used to determine whether speakers are matching or non-matching speakers.

With additional reference to FIG. 3, an example of a comparator circuit 201 is illustrated. In this example, each speaker 14 and 15 may include pin sets 302 and 304 that have two pins that may either be shorted together (e.g., shorted to ground 311 as shown in FIG. 3) or that may not shorted together (as will be discussed with reference to FIG. 8)—dependent upon the vendor (e.g., vendor A or vendor B). In the first example, FIG. 3, for vendor speakers A, two pins of pin sets 302 and 304 (e.g., pins 1 and 6) are shorted together to ground 311.

As will be described, comparator circuit 201 may use the input signals 202 and 204 to determine the output state signal (Vout) 210 through an operational amplifier 310 as: a low state for one vendor (e.g., vendor A), a high state for another vendor (e.g., vendor B), or an error state (e.g., an oscillation signal—such as, a 50% duty cycle oscillation) for a miss-match of vendor speakers (e.g., vendor speakers A and B connected). The comparator circuit 201 may be a rail-to-rail, push-pull comparator powered by Vcc 312, as shown. It should be appreciated that FIG. 3 is just an example of a comparator circuit that may be utilized to implement the determination of matching or non-matching speakers 14 and 15 from common or different vendors.

In this example, FIG. 3 shows a first speaker 14 (left hand side) and a second speaker 15 (right hand side) connected to comparator circuit 201, in which the comparator circuit 201 includes various resistors and a capacitor 315 and operational amplifier 310 that outputs the state signal 210 (Vout). Speakers 14 and 15 may be from either a first or second speaker vendors (e.g., vendor A or vendor B) or may be a miss match/error case (e.g., a speaker from vendor A and a speaker from vendor B). Comparator circuit 201 through operational amplifier 310 may output a single state signal output (Vout) 210 to designate to data processor 8 whether: vendor A speakers are attached; vendor B speakers are attached, or a miss-match of vendor speakers are attached. In this way, data processor 8 may implement the appropriate software: EQ software for speakers from Vendor A 220; EQ software for speakers from Vendor B 222; Different Vendor software 230 to indicate speaker error—as previously described in detail. It should be noted that, as examples, as will be described in more detail, one speaker vendor (e.g., vendor A) may have pins 1 and 6 shorted with a jumper wire 310 whereas another speaker vendor (e.g., vendor B) does not have a jumper present.

As a first particular example, as shown in FIG. 3, for one speaker vendor (e.g., vendor A), two pins of pin sets 302 and 304, pin 6, may be shorted to ground 311. Further, pin 1 of the first left speaker 14 is connected to left speaker input signal 202 and pin 1 of the second right speaker 15 is connected to the right input signal 204, both of which are connected to the positive input of the operational amplifier 310 of the comparator circuit 201.

Figure 4:
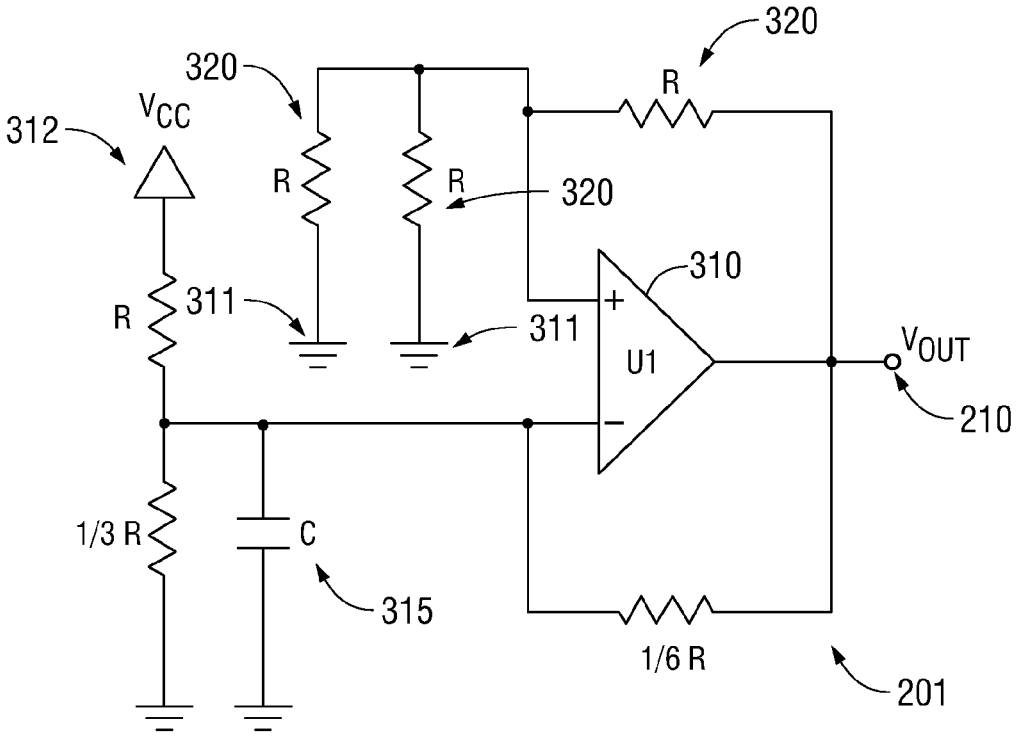
FIG. 4 is a circuit diagram of the comparator circuit when both jumpers are inserted for the speakers and the speaker ID inputs are grounded.

With additional reference to FIG. 4, an example of the operation of comparator circuit 201, in which the first and second speakers 14 and 15 from vendor A are connected and are grounded to ground 311, will be described. In this example, the speaker ID inputs 202 and 204 are both connected to GND 311 effectively removing the connections to Vcc 312. The positive input to the operational amplifier 310 is pulled low through three parallel resistors 320. Further, at startup, voltage Vc of capacitor 315 should be approximately 0 V.

Noise on the inputs to the operational amplifier 310 could result in the output state signal (Vout) 210 going either low or high.

Figure 5:
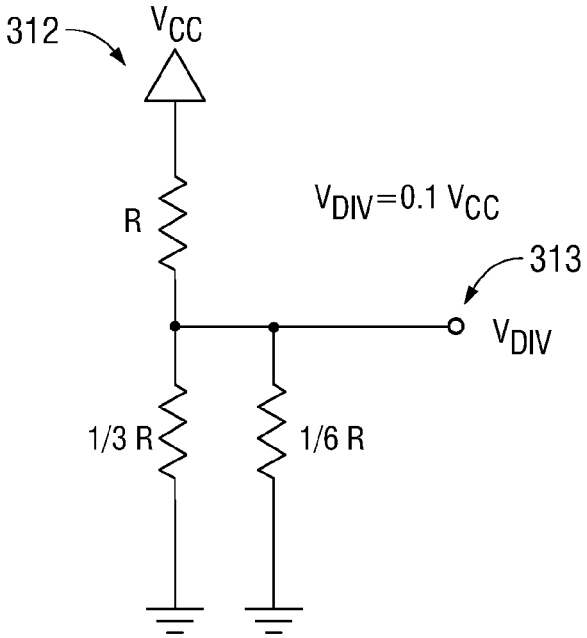
FIG. 5 is a circuit diagram illustrating a settled negative input to the operational amplifier.

In the output low case, the positive input to the operational amplifier 310 is pulled low through the three parallel resistors 320. With additional reference to FIG. 5, after several time constants, the voltage at the negative input of the operational amplifier 310 may approximately settle to 0.1 Vcc 313 [$V_{DIV}$]. Because the negative input to the operational amplifier 310 is greater than the positive input to the operational amplifier 310, the output of the operational amplifier 310, state signal 210 (Vout), should always remain low. In this way, the outputted state signal 210 of comparator circuit 201 is a low state signal.

Figure 6:
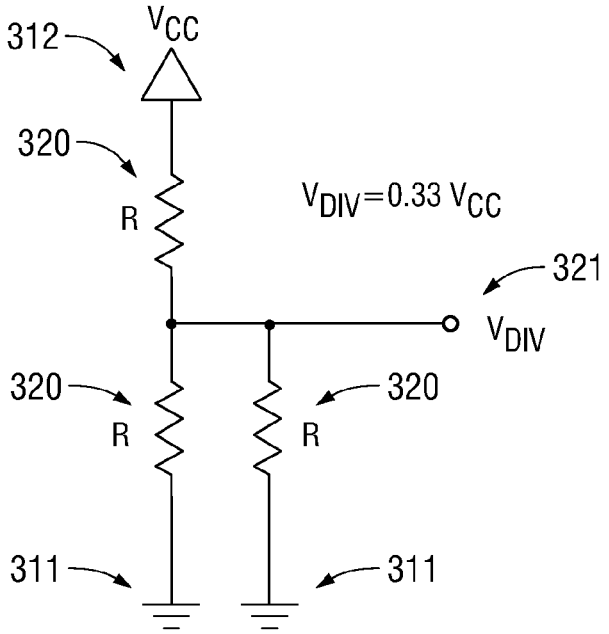
FIG. 6 is a circuit diagram illustrating a positive input to the operational amplifier.
Figure 7:
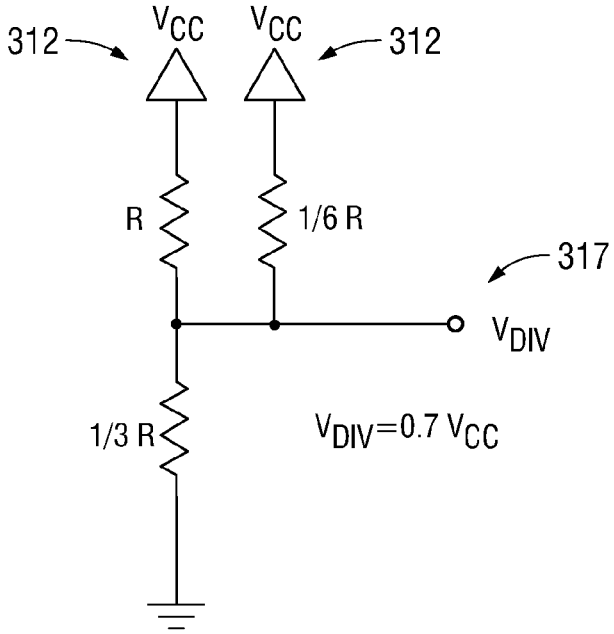
FIG. 7 is a circuit diagram illustrating a settled negative input to the operational amplifier.

In the output high case, with additional reference to FIG. 6, the voltage at the positive input to the operational amplifier 310 may be 0.33 Vcc [$V_{DIV}$] 321. In this instance, with additional reference to FIG. 7, the capacitor 315 at the negative input to the operational amplifier 310 will attempt to charge to 0.7 Vcc 317 [$V_{DIV}$]. However, when it reaches 0.33 Vcc, the operational amplifier's 310 output (Vout 210) will go low. All three resistors 320 connected to the positive input of the operational amplifier 310 will be pulled low. The capacitor 315 at the negative input will discharge to 0.1 Vcc, which is still greater than GND, so that operational amplifier 310 output Vout 210 will remain low. In this way, the outputted state signal 210 of comparator circuit 201 is a low state signal.

Figure 8:
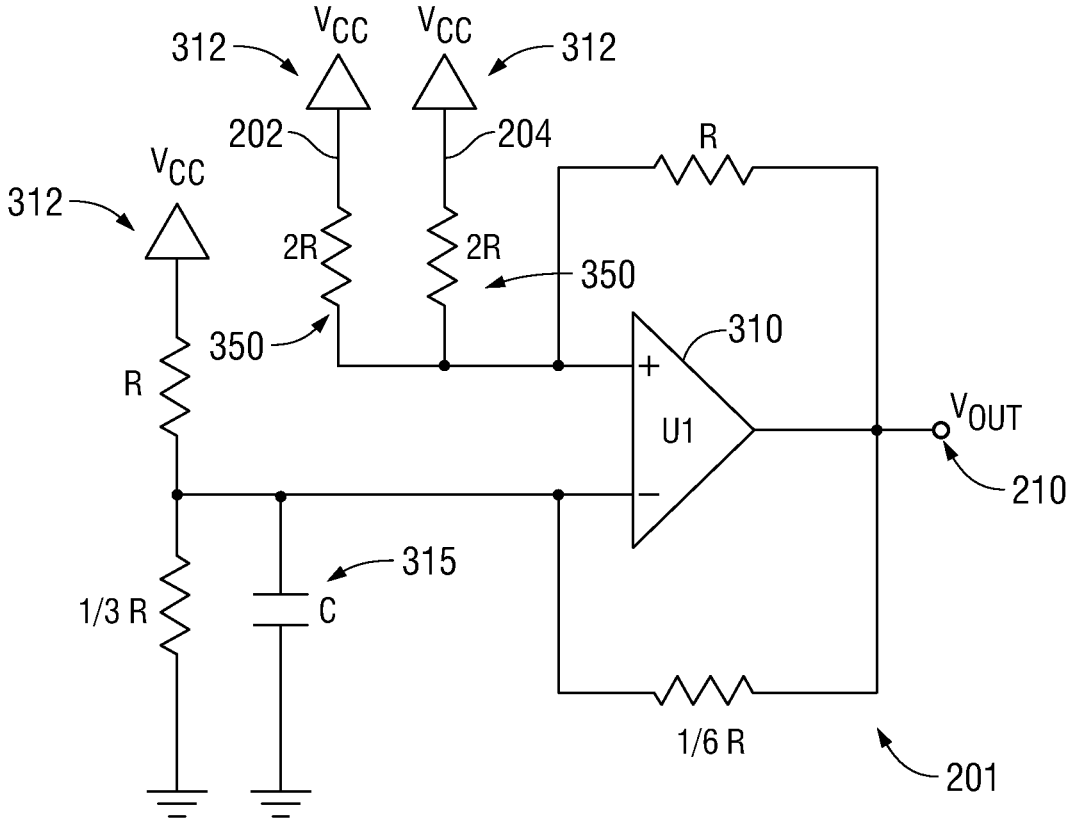
FIG. 8 is a circuit diagram of the comparator circuit when both jumpers for the speakers are empty and the speaker ID inputs are both floating.

With additional reference to FIG. 8, in another embodiment, in which the first and second speakers 14 and 15 are from another vendor (e.g., vendor B), both of the speakers are directly connected (e.g., without being directly grounded) to the comparator circuit 201. In particular, the left and right speaker input lines 202 and 204 are both floating, leaving each leg tied to Vcc 312 through two series R resistors 350.

In this example, at startup, the voltage of capacitor 315 (Vc) should be zero. The positive input of operational amplifier 310 should be pulled high through the parallel 2R-2R-R resistors 350. Therefore, the operational amplifier 310 output will remain positive. The capacitor 315 at the negative input of the operational amplifier 310 should charge to 0.7 Vcc; which is not high enough to turn the operational amplifier 310 output low. Because of this, the operational amplifier 310 output 201 Vout provides a high state signal to the data processor 8, as previously described. Thus, in this way, the outputted state signal 210 of comparator circuit 201 is a high state signal.

Figure 9:
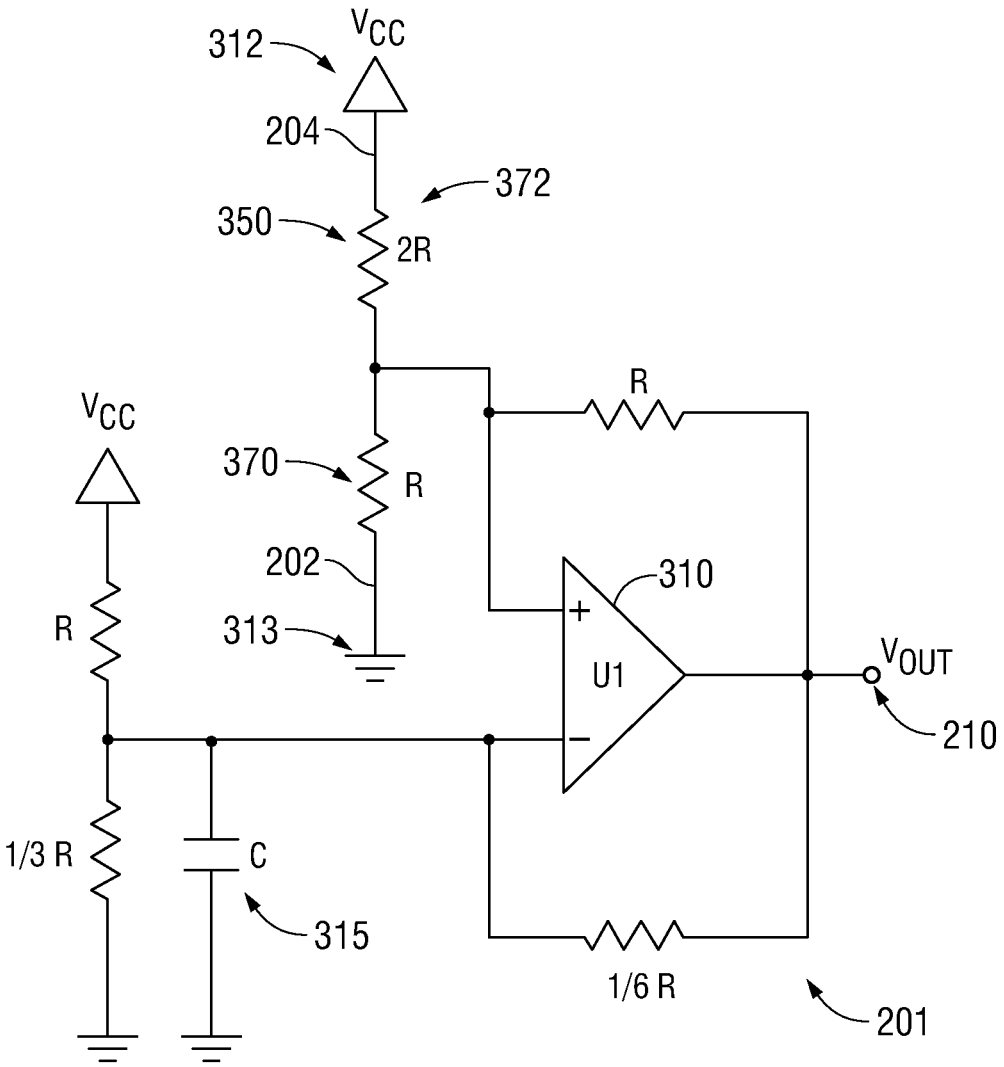
FIG. 9 is a circuit diagram of the comparator circuit when one jumper is inserted for a speaker (speaker grounded) and the jumper for another speaker is empty (floating) such that the comparator circuit outputs an oscillation signal.

In another embodiment, with additional reference to FIG. 9, one speaker from vendor A 370 may be connected to one speaker connector while another speaker from vendor B 372 may be connected to the other speaker connector. This in an error case. In this instance, one speaker ID input 204 is left floating, leaving that leg tied to Vcc 312 through two series R resistors 350, while the other speaker ID input 202 (e.g., from the right speaker) is shorted to GND 313.

Figure 10:
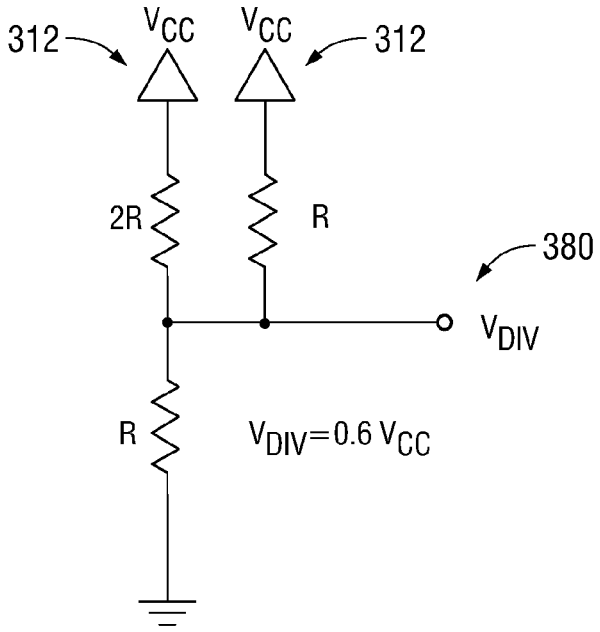
FIG. 10 is a circuit diagram illustrating a positive input to the operational amplifier in which the output of the operational amplifier is high.

In this configuration, the comparator circuit 201 forms a modified relaxation oscillator. With additional reference to FIG. 10, from a normal startup, the capacitor voltage (Vc) will be zero Volts, while the voltage at the positive terminal of the operational amplifier 310 will be approximately 0.6 Vcc [$V_{DIV}$] 380.

Figure 11:
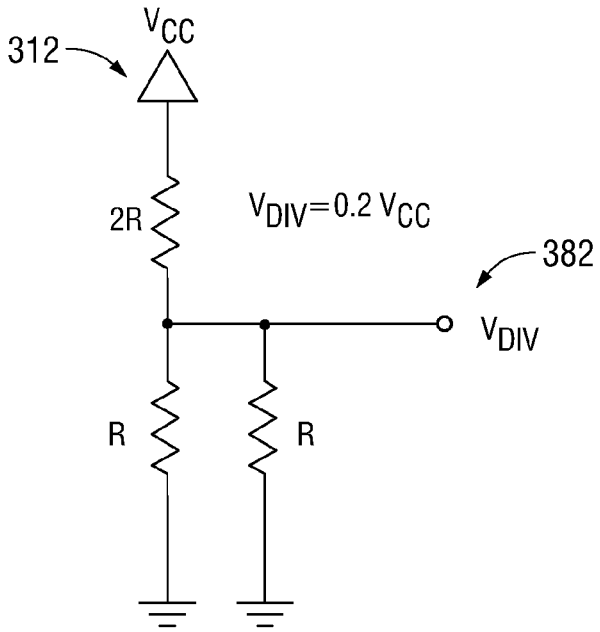
FIG. 11 is a circuit diagram illustrating a positive input to the operational amplifier in which the output of the operational amplifier is low.

With additional reference to FIG. 11, the capacitor 315 at the negative terminal of the operational amplifier 310, will attempt to charge to 0.7 Vcc, but when it reaches 0.6 Vcc, the operational amplifier 310 output 210 will go low, changing the voltage at the positive terminal of the operational amplifier 310 to approximately 0.2 Vcc [$V_{DIV}$] 382.

The capacitor 315 at the negative terminal of the operational amplifier 310 will then attempt to discharge to 0.1 Vcc, but when it reaches 0.2 Vcc, the output 210 of the operational amplifier 310 will go high, changing the voltage at the positive terminal of the operational amplifier 310 to approximately 0.6 Vcc. This process will continue so long as Vcc remains present resulting in a square wave at the output 210 of the operational amplifier 310. Thus, in this way, the outputted state signal 210 of comparator circuit 201 is an oscillation state signal (e.g., an oscillation signal—such as, a 50% duty cycle oscillation square wave).

It should be noted that because the Thevenin equivalent resistors are the same in both the charging and discharging case—the parallel combination of R, ⅓R, and ⅙R—and the delta between the trip and charge- to voltages is the same—0.1 V—the charging and discharging times will be the same, resulting in a 50% duty cycle square wave. Further, the frequency of oscillation may be tunable by appropriately setting the values of R and C.

Starting with the general capacitor charging/discharging equation:

$$\Delta V = (V_{final} - V_{start})\left(1 - e^{\frac{-t}{\tau}}\right)$$

The required time constant may be calculated to yield a particular charge time, given the charge-to-voltages and trip point voltages. The equation for the time constant is:

$$\tau = \frac{-t}{\ln\left(1 - \frac{V_{change}}{V_{final} - V_{start}}\right)}$$

Where:

$V_{change}$=delta between trip points $V_{final}$=charge to/discharge to voltage $V_{start}$=initial voltage (previous trip point)

t=time to charge/discharge (set to one-half the desired frequency)

Plugging in RC for τ and solving for t, it can be found that:

$$t = -C \cdot \ln\left(1 - \frac{V_{change}}{V_{final} - V_{start}}\right) \cdot R$$

R may be determined using the Thevenin equivalent value for the charging circuit. It should be appreciated that a table or spreadsheet may used to adjust values of R and C as they relate to oscillation frequency, including tolerance, in order to simplify the design.

Figure 12:
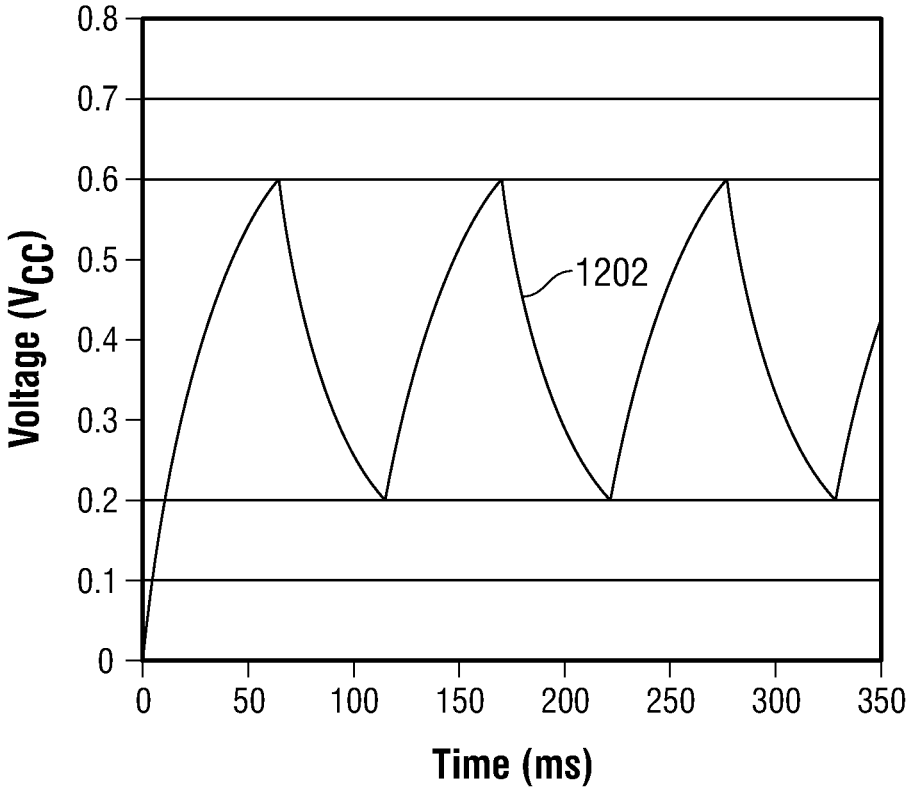
FIG. 12 is chart illustrating an oscillation wave in terms of Voltage Vcc (y-axis) and time (x-axis).

With additional reference to FIG. 12, oscillation wave 1202 in terms of Voltage Vcc (y-axis) and time (x-axis) can be seen as controlled by the comparator circuit 201 and the previously described equations. In particular, it should be seen in FIG. 12 that the Vcc voltage oscillates between 0.6 Vcc and 0.2 Vcc, as shown by oscillation wave 1202, which is the result of the control by the comparator circuit 201 and represents the outputted oscillating state signal 210 of comparator circuit 201, as previously described.

Thus, as previously described in detail, comparator circuit 201 by utilizing speaker vendor inputs from two speaker connectors, either of which may be floating or tied to ground, may generate a state signal 210 that is either: a logic level high, a logic level low, or a low speed oscillating square wave signal. By sampling the state signal over a short period of time, it may be determined which input is present (e.g., speakers from vendor A, speakers from vendor B, or miss-matched vendor A and vendor B speakers). In the case of the miss-matched speakers, the comparator circuit 201 can determine this by acting as a relaxation oscillator. The output state signal 210 (e.g., low, high, or oscillation) may be connected to data processor 8 of the electronic audio device that includes software programs to equalize vendor A speakers (EQ software speaker vendor A) 220; equalize vendor B speakers (EQ software speaker vendor B) 222, or to alert manufacturing or re-working personnel, utilizing different vendor software 230, through a displayed and/or sound-based cue, that miss-matched speakers have been assembled to the electronic audio device. Also, as previously described, instead of display software and/or a display, a diagnostic tool may be used to determine if the first and second speakers 14 or 15 are from different vendors and that an error has occurred. When this occurs, they can remove and replace the speakers to make sure that common vendor speakers are installed.

It should be appreciated that the use of first and second speakers 14 and 15 are merely examples of a pre-determined number of speakers (e.g., two speakers) and that any number of speakers (e.g., N speakers) having corresponding input signals may also be coupled to comparator circuit 201, in which, the comparator circuit may determine whether the speakers 1-N are matching or non-matching speakers. Further, it should be appreciated that the comparator circuit 201 may be designed to determine and identify any number (N) of different speaker vendor types with state signals that are transmitted to the data processor 8 and that the data processor may likewise provide EQ software for any number (N) of vendor speakers. Additionally, comparator circuit 201 may be designed to determine mismatches of any number (N) of different vendor speakers and the data processor 8 may likewise be designed to alert technical personnel of such different vendor speakers.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio system depicted in the figures may be a smart phone, digital media player, or a tablet computer, the audio system may alternatively be a different portable device such as a laptop computer, or even a non-portable device such as a desktop computer or a home entertainment appliance (e.g., digital media receiver, media extender, media streamer, digital media hub, digital media adapter, or digital media renderer). The description is thus to be regarded as illustrative instead of limiting.

What is claimed is:

1. An electronic audio device comprising:

a first speaker connector and a second speaker connector, wherein each of the first speaker connector and the second speaker connector has a pin that is to be either shorted to another pin or not shorted to said another pin;

a comparator circuit coupled to a first speaker through the first speaker connector, and coupled to a second speaker through the second speaker connector, the comparator circuit to output a) a first stable state in response to the pin on both the first and second speaker connectors being shorted, b) a second stable state in response to the pin on both the first and second speaker connectors not being shorted, and c) a third oscillation state in response to the pin on the first speaker connector being shorted and the pin on the second speaker connector not being shorted.

2. The electronic audio device of claim 1, wherein the first and second speakers are common vendor speakers if the first or second stable state, not the third oscillation state, is outputted by the comparator circuit.

3. The electronic audio device of claim 1, wherein the first and second speakers are common vendor A speakers when the comparator circuit outputs the first stable state, and common vendor B speakers when the comparator circuit outputs the second stable state.

4. The electronic audio device of claim 3, wherein the pin on both the first and second speaker connectors are 1) grounded when the first and second speakers are common vendor A speakers, and 2) not rounded when the first and second speakers are common vendor B speakers.

5. The electronic audio device of claim 3, further comprising a processor to execute equalizing software, wherein when the first stable state is received by the processor, the processor in response executes equalizing software that is associated with common vendor A speakers.

6. The electronic audio device of claim 3 further comprising a processor to execute first and second equalizing software, wherein 1) when the first stable state is received by the processor, the processor in response executes said first equalizing software, and 2) when the second stable state is received by the processor, the processor executes said second equalizing software.

7. The electronic audio device of claim 1, wherein the first and second speakers are from different vendors if the third oscillation state is outputted by the comparator circuit.

8. The electronic audio device of claim 7, wherein the pin on the first speaker connector being grounded and the pin on the second speaker connector not being grounded cause the comparator circuit to output the third oscillation state.

9. The electronic audio device of claim 8, further comprising a processor, wherein when the third oscillation state is received by the processor, the processor executes software to display that the first and second speakers are from different vendors.

10. A method comprising:

supplying a signal to a first speaker to detect a first response from the first speaker;

supplying a signal to a second speaker to detect a second response from the second speaker; and producing one of a) a first stable state signal when both of the first and second responses are of a first type, b) a second stable signal when both of the first and second responses are of a second type, and c) a third oscillation signal when the first and second responses are of different types.

11. The method of claim 10, wherein the first and second speakers are from a first vendor if the first stable state signal is produced and provided to a processor.

12. The method of claim 11, wherein the first stable state signal received by the processor causes the execution of equalizing software associated with the first vendor.

13. The method of claim 10, wherein the first and second speakers are from a second vendor if the second stable state signal is produced and provided to a processor.

14. The method of claim 13, wherein the second stable state signal received by the processor causes the execution of equalizing software associated with the second vendor.

15. The method of claim 10, wherein the first and second speakers are from different vendors if the third oscillation signal produced and provided to a processor.

16. The method of claim 15, wherein the received third oscillation signal causes the processor to execute software to display that the first and second speakers are from different vendors.

17. An electronic audio system comprising:

a first speaker;

a second speaker, each of the first and second speakers has a respective pin;

a comparator circuit coupled to the first speaker through the respective pin of the first speaker and coupled to the second speaker through the respective pin of the second speaker, wherein the comparator circuit is configured to output a) a first stable state in response to the respective pins of both the first and second speakers being grounded, b) a second stable state in response to the respective pins of both the first and second speakers not being grounded, and c) a third oscillation state in response to the respective pin of the first speaker being grounded and the respective pin of the second speaker not being grounded; and a processor to receive the output of the comparator circuit through a single wire.

18. The electronic audio system of claim 17, wherein the first and second speakers are common vendor speakers if the comparator circuit is to output the first stable state to the processor.

19. The electronic audio system of claim 18, wherein the first stable state is received by the processor and the processor executes equalizing software associated with the common vendor speakers.

20. The electronic audio system of claim 17, wherein the processor is to execute first equalizer software when the output of the comparator circuit is the first stable state, and second equalizer software when the output of the comparator is the second stable state.

21. The electronic audio system of claim 17, wherein the first and second speakers being from different vendors causes the comparator circuit to output the third oscillation state to the processor.

22. The electronic audio system of claim 21, wherein the processor executes software to display that the first and second speakers are from different vendors.

* * * * *